United States Patent [19]

Perry

[11] 4,186,074

[45] Jan. 29, 1980

[54] CATHODE FOR USE IN THE ELECTROLYTIC REFINING OF COPPER

[75] Inventor: Ian J. Perry, Townsville, Australia

[73] Assignee: Copper Refineries Pty. Limited, Queensland, Australia

[21] Appl. No.: 10,927

[22] Filed: Feb. 9, 1979

[51] Int. Cl.[2] ..... C25C 7/02

[52] U.S. Cl. ..... 204/286; 204/288

[58] Field of Search ..... 204/106, 286–289

[56] References Cited

U.S. PATENT DOCUMENTS

| | | | |
|---|---|---|---|
| 3,298,945 | 1/1967 | Weis et al. | 204/286 X |
| 3,424,668 | 1/1969 | Fischer | 204/286 X |
| 3,530,047 | 9/1970 | Billett | 204/286 X |
| 3,857,774 | 12/1974 | Morton et al. | 204/288 X |
| 4,014,763 | 3/1977 | Lowe | 204/286 X |

*Primary Examiner*—John H. Mack
*Assistant Examiner*—D. R. Valentine
*Attorney, Agent, or Firm*—Stevens, Davis, Miller & Mosher

[57] ABSTRACT

A cathode for use in the electrolytic refining of copper, comprises a stainless steel hanger bar having a flat undersurface with end portions to rest on supports and electrical contacts, and a flat stainless steel starter sheet welded to the undersurface between said end portions and by one edge so to project perpendicularly from that surface. At least the upright side edges of the sheet are masked to prevent copper deposit thereon, and to improve conductivity from bus-bar to hanger bar and to starter sheet, the hanger bar and that edge margin of the starter sheet welded to it are clad with copper.

10 Claims, 6 Drawing Figures

CATHODE FOR USE IN THE ELECTROLYTIC REFINING OF COPPER

This invention relates to cathodes as used in the electrolytic refining of copper.

For over fifty years and up to the present the most commonly used cathode of the type in question has been in the form illustrated, by way of a perspective sketch, in FIG. 1 of the drawings herewith. Neither FIG. 1 nor FIG. 2 (referred to later herein) are drawn to scale, having certain parts disproportionately enlarged so as more clearly to illustrate the details of construction.

Referring to FIG. 1, the prior art cathode consists of a copper hanger bar 7, a copper starter sheet 8 and a pair of copper loops or straps 9 by which the sheet is hung on the bar. The end portions 10 of bar 7 project beyond the width of sheet 8 so that they may rest, for support, on the cell sides with one making the usual electrical contact, and with the starter sheet between a pair of anode plates of unrefined copper, both being immersed in the electrolyte of a refining cell, or between a pair of insoluble anodes both immersed in the electrolyte of an electro-winning cell.

Notwithstanding their long use in the industry, it is well recognised that the prior cathodes are open to objection in several respects. For example:

(a) The copper starter sheets are not re-usable. That is to say, they cannot be stripped of the copper desposited on them and then put back in the cell to receive a fresh copper deposit. The present and most economical practice is to melt the starter sheet copper, along with the copper deposited on it, and from the melt produce wirebars, rod, cakes, billets and other copper stock commodities in marketable condition. A fraction of the melt output could be used for making fresh starter sheets, experience has shown however that it is more economic to produce fresh starter sheets electrolytically; but even so, the man-hour expenditure is extremely high because it involves stripping of starter sheets from mother plates, flattening of sheets, making and attaching the loops, and assembly of the looped sheets with support bars.

(b) The copper starter sheets are not easily made truly flat and even when they are substantially flat to start with they frequently warp in service and this gives rise to short circuiting between cathode and anode. Even where loss of flatness is not as bad as that, any departure from parallelism between cathode and anode causes non-uniformity of copper deposit, with excess deposit at "peak" or short-path points accelerating short circuiting at those points. Short circuiting is a serious problem in that it is necessary to use a term of men whose task consists entirely of patrolling the tank-house to remedy short circuits.

(c) Sometimes the loops 9 make little more than line, or even point, contact with the support bar 7. This does not impair the actual copper deposit process, but it does increase resistance and consequently power costs are increased.

Extensive research and experiment have been carried out in the copper refining industry to improve the mother plate from which the starting sheets are produced. Some work was done with stainless steel but was generally unsuccessful due to inconsistency in results which gave problems such as passivity, localised corrosion and variable adhesion of the copper deposits.

Titanium starter blanks have had considerable acceptance because of the inherent characteristics of titanium which provide an oxide film which appears well suited to overcoming the problems of too little or too much adhesion of the copper deposit and its corrosion resistance is exceptionally good. The most advanced form of titanium re-usable starter plate or cathode is complex in consisting of a composite hanger bar primarily composed of copper and incorporating a titanium component to which a titanium starter plate is welded. In one form, the hanger bar is a copper bar encased in a titanium shell and the top marginal portion of the starter plate is goose-necked so that that portion may be welded directly to one side of the hanger bar encasement. In another form the hanger bar is a copper bar having a core rod of titanium inside and running longitudinally of it. In this case, the starter plate is goose-necked as before and is welded to the core rod by way of short studs of titanium which extend through holes in the copper bar, each stud having one end welded to the core rod and its other end welded to the starter sheet margin.

An example of the prior "titanium" arrangement just described is provided by that subject of United Kingdom Pat. No. 1415793.

However, titanium is not without its shortcomings. It is expensive and its production in a practical form is complicated. The original object of the present invention was to overcome or ameliorate at least some of the mentioned shortcomings and in a preferred embodiment, all of those shortcomings, in a particularly simple and inexpensive manner by the provision of a cathode which is virtually entirely of stainless steel, is indefinitely re-usable, maintains its flatness, provides an unimpaired current path between bus-bar and hanger bar and between that bar and the plate, provides a permanent oxide coating acting as an effective parting layer facilitating stripping of deposit copper from the starter blank while providing sufficient adhesion for retention of deposited copper during build-up, and is particularly amenable to mechanical handling in its manufacture and use.

Experimental use of invention has proved so successful that it is considered economic to extend the use of this cathode throughout applicants electrolytic copper refining tank house.

The conventional method of refining makes use of starter blanks in a limited number of cells to produce two thin sheets of refined copper from each plate each day. These sheets are then assembled into the cathode as shown in FIG. 1.

The special starter sheet manufacturing operation involving additional control, higher power consumption per ton of product, and considerable expenditure on labour can be eliminated by the use of the present invention in all cells and for a longer time growth (a week or more instead of only 24 hours) before stripping. It also provides a suitable electrode for mechanical handling and mechanical stripping of which the product is commercial refined cathode copper.

In addition the accurate dimensions of the starter blank, when coupled with accurately dimensioned anodes, provide the facility to operate at closer spacing of electrodes thereby considerably reducing power costs, and most importantly largely eliminating short circuits, thus further reducing labour costs and offering a better facility for computer monitoring of short circuits. Furthermore the more intensive operation made possible with closer spacing, and the higher current density at which the refining operation can be performed because of the elimination of short circuits, means that the plant for a given annual capacity can be housed in a smaller building, thus offering considerable savings in capital investment for that building.

The elimination of starter sheets and their requirement of special, larger area, anodes and particularly the ability to take more "pulls" from a loading of anodes all reduce the amount of "working" copper in the process at any time. As this reduction can be of the order of 20% of say 10,000 tons, the amount of money invested in the copper in process is considerably reduced.

The invention provides a cathode for use in the electrolyte refining of copper, comprising:

A stainless steel hanger bar having a flat undersurface with end portions adapted to rest upon supports and electrical contacts.

A flat stainless steel starter sheet welded by its upper edge to said undersurface between said end portions and so as to extend perpendicularly from said undersurface, a copper cladding which envelops said bar and at least the marginal upper portion of said sheet by which it is welded to said undersurface, and means to mask at least the upright side edges of said sheet.

It will be appreciated that terms used herein, such as "undersurface", "upper edge" and others implying a specific orientation for a cathode or the parts thereof, are used for descriptive convenience. Such terms are literally applicable to a cathode when in normal use suspended in an electrolytic cell.

A preferred embodiment of the invention is illustrated in FIGS. 2 to 6 of the drawings herewith.

Figure 1:
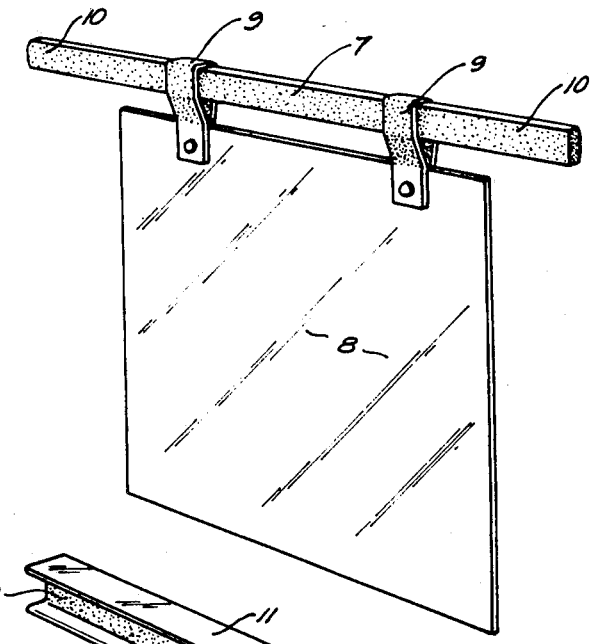
Figure 2:
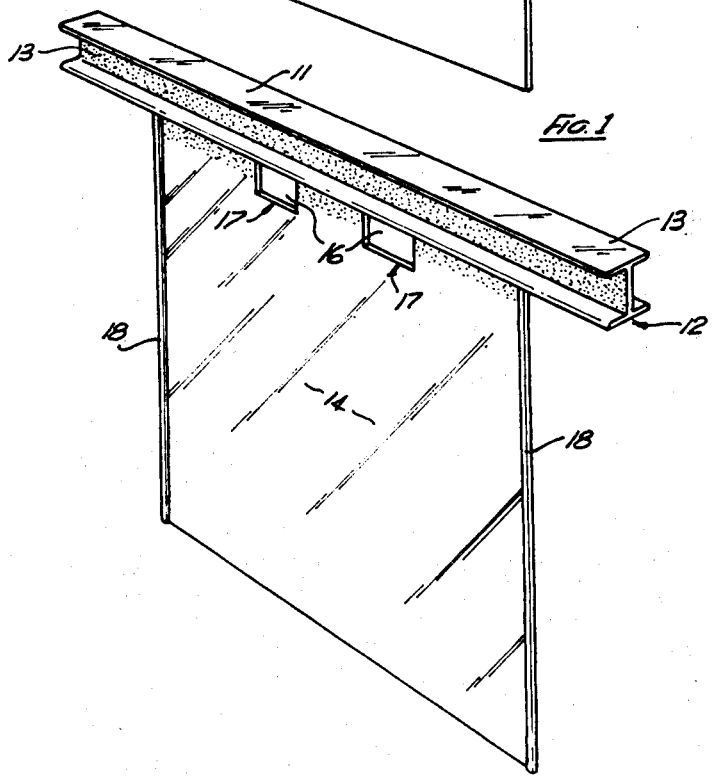
FIG. 2 is a perspective view of a cathode not drawn to scale as previously explained.
Figure 3:
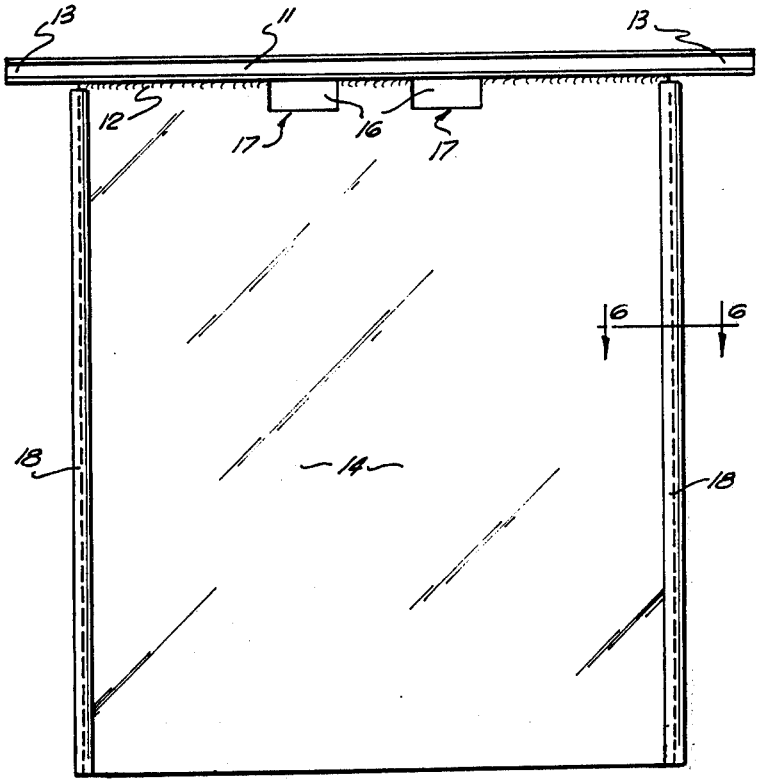
FIG. 3 is a side elevation of the same cathode when drawn to a presently preferred scale.
Figure 4:
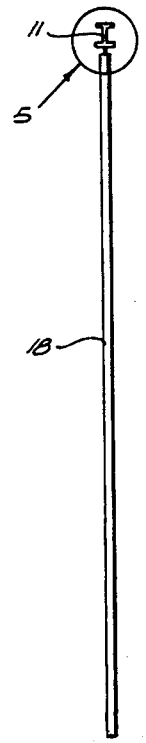
FIG. 4 is an end elevation projected from FIG. 3.
Figure 5:
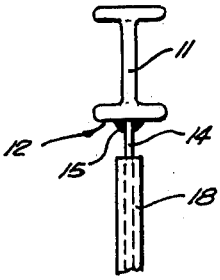

FIG. 5 repeats, on a enlarged scale, that part of FIG. 4 enclosed by circle 5.

Figure 6:
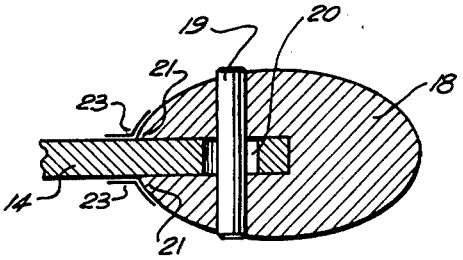

FIG. 6 is a section taken on line 6—6 on a still further enlarged scale.

Referring to FIGS. 2 to 6, a stainless steel hanger bar 11 is preferably of RSJ or I-beam cross-sectional shape as shown. It could be of some other shape, but that shown is preferred because it is of light weight and hence economical of the steel employed, it is structurally sound and it provides a relatively large surface area for the current to be transmitted. Bar 11 has a flat undersurface 12 and end portions 13 adapted to rest on support and electrical contacts as well understood.

A flat stainless steel starter sheet 14 is welded, as indicated at 15 in FIG. 5, by its upper edge to undersurface 12 so that the sheet extends perpendicularly from the undersurface 12. Sheet 14 preferably has a pair of holes 16 gapped from it prior to welding. These holes facilitate mass handling of a number of the cathodes by support rods or prongs extended through the holes.

A range of stainless steels may serve effectively as starter plates according hereto, for ease of copper stripping however we prefer to use that grade of stainless steel marketed as "AISI 316 ELC" and having what is known as a "2B" standard of surface finish. This steel is one having an approximate analysis of:

Carbon — 0.03% by weight
Nickel — 12.0% by weight
Chromium — 17.0% by weight
Molybdenum — 2.25% by weight and the 2B surface finish is one intermediate bright and dull, being a silvery-grey, semi-bright surface produced by cold rolling, softening and descaling, and then final rolling lightly with polished rolls.

The indicated steel and surface finish are preferred, as experiment has shown that they provide a sufficient tenacity of attachment between the steel sheet and the copper deposited therein to prevent the copper from peeling or slumping from the steel on its own accord; yet, this tenacity is not such as to impede ready stripping of the copper from the steel sheet. Stripping may be performed by use of knife-like blades or knife-edge wedges inserted between the steel sheet and the deposited copper at the upper edge of the copper; however, using stainless steel of the kind and surface finish indicated above, our experiments have shown that effective stripping may be carried out automatically by passing the copper laden cathodes through a hammering station in which the deposited copper is smartly rapped near its upper edge from both sides, this loosens the copper upper edge and stripping is then finished by directing one or more streams of air into the minute space between the steel and the loosened upper edge of the copper.

The stainless steel out of which the hanger bar is made may be the same as that from which the starter sheet is made. The bar may however, be of any other stainless steel provided it is one to which the sheet is weldable.

As previously mentioned herein, stainless steel is not a particularly good conductor, and use of a hanger bar made only of such steel is not a sufficient vehicle for passage of current between bus-bar and starter sheet. We have found that this can be overcome by simply cladding the hanger bar, and a top margin of the sheet welded to it, with copper. This cladding may be applied by published techniques of plating and a thickness of about 1 m.m. is preferred to provide adequate electrical conductivity and the ability to withstand corrosion and machanical drainage. It will be recalled that earlier herein the presence of an oxide film on the starter plate is regarded as desirable owing to its ability to act as a parting layer to facilitate stripping of copper from the sheet.

The width of the copper plated margin at the top of the starter sheet is not critical provided it stops short of the top surface of the electrolyte. Obviously, deposit of copper on the plating area must not occur. Similarly, the plating area on which refined copper will be deposited in the operating process must not extend onto the lower edges 17 defining holes 16. It follows, that the copper plating may conveniently stop short of the edges 17 provided it covers the (preferably sand-blasted) weld metal at 15.

It will be apparent that ease of copper stripping requires effective masking of the starter sheet edges so that the deposit of copper will not be continuous about those edges. This is particularly the case with the upright side edges of the plate. The bottom edge is less in need of masking and in the case of that edge masking could be omitted; however, to improve assurance of clean stripping we prefer to mask the bottom edge merely by giving it a hot dip, to a depth of about 10.00 mm, of a high melting point resilient wax, or other masking material.

With regard to masking of the side edges of the starter sheet the present invention displays a further important advantage over the titanium sheets referred to previously herein.

In titanium starter sheets, owing to the relatively high conductivity of that metal, there is a proneness for creep of deposit copper particles under the masking strip material. Once that happens copper nodules continue to grow under the mask strip (usually of plastics material) thus tending to lift the strip and so defeat the reason for masking and also create the need for re-masking before further use.

With stainless steel starter sheets, the relatively poor conductivity discourages copper growth under the masking means and such growth is thereby reduced to such a degree as to become inconsequential.

Notwithstanding this, the desirability of effective masking of at least the side edges of the starter sheet remains; and, for preference, the form of masking which we employ is as shown best in FIG. 6.

Referring mainly to that figure, the masking means comprise a longitudinally slotted plastics beading 18 held on to the sheet 14 by plastics pins 19. These pins extend through holes 20 formed in plate 14.

The beading 18 and the pins 19 are preferably made of the same plastics material, and one suitable material is a high quality, heat and impact resistant plastic such as that known as CYCOLOY 800. This being a polymeric alloy of acrylonitrile-butadiene-styrene, (ABS) and polycarbonate as described in U.S. Pat. No. 3,130,177.

The beading 18 and the pins 19 are secured together by use of a suitable bonding material such as a 30% solution of Cycoloy 800 in methylene chloride.

Such a bonding material sets to an elastic condition and in addition to acting as a bonding agent it serves a useful purpose in the following manner.

During the experimentation which led up to the present invention it was found that on some occasions there was a tendency for the applied beadings to slightly bulge between the pin fastenings. This was, of course, objectionable and it was considered to be due to difference in expansion rates between the steel and the beading. This situation was remedied by making the holes 20 oversized as shown in FIG. 6. In applying the beadings and the pins the holes 20 are filled by the solvent material which sets to an elastic condition so to act as expansion joints permitting sufficient longitudinal movement of the beading relative to the starter sheet as will compensate for the expansion rate difference.

The beadings 18 are preferably first formed by extrusion, or injection moulding, and in this action it is desirable for the points 21 defining the aperture of slot 22 to be placed closer to each other than is shown in FIG. 6. Thus, when the beading is applied to the sheet, the sides of the slot 22 have an inbuilt resilient loading tending to press them firmly in contact with the sheet.

As further precaution the points 21 are preferably sealed relative to the starter sheet by the application of wax or other material sealing strips as indicated at 23.

The claims defining the invention are as follows:

1. A cathode for use in the electrolytic refining of copper, comprising:

a stainless steel hanger bar having a flat undersurface with end portions adapted to rest upon supports and electrical contacts, a flat stainless steel starter sheet welded by its upper edge to said undersurface between said end portions and so as to extend perpendicularly from said undersurface, a copper cladding which envelopes said bar and at least the marginal upper portion of said sheet by which it is welded to said under surface, and means to mask at least the upright side edges of said sheet.

2. A cathode according to claim 1 wherein said hanger bar is of I-beam cross-sectional shape.

3. A cathode according to claim 1 or claim 2 wherein said starter sheet has lifting holes formed in it as gaps in that edge of the sheet by which it is welded to said hanger bar.

4. A cathode according to any one of the preceding claims wherein said starter sheet is formed of stainless steel containing:

Carbon — 0.03% by weight
Nickel — 12.0% by weight
Chromium — 17.0% by weight
Molybdenum — 2.25% by weight

5. A cathode according to any one of the preceding claims wherein said copper cladding is formed by plating.

6. A cathode according to any one of the preceding claims wherein said masking means comprise plastics beadings each having a longitudinal slot by which the beading embraces the sheet, and a plurality of plastics pins extending through holes formed in said sheet and having those portions of them disposed on either side of said slot bonded within said beading.

7. A cathode according to claim 6 wherein said beading is so formed by extrusion and said pins are so applied thereto that the sides of said slot are resiliently loaded to bear firmly against a starter sheet portion placed therebetween.

8. A cathode according to claim 6 or claim 7 wherein the holes in said sheet to receive said pins are over-sized relative to said pins and the open space thus created is filled with elastic solvent material so that each of the joints established by said pins constitutes an expansion joint.

9. A cathode according to any one of claims 6 to 8 wherein said masking means include wax strips by which the interior of said slot is sealed in relation to that portion of the starter sheet inserted in said slot.

10. A cathode according to any one of the preceding claims wherein the lower edge of said sheet is masked by a coating of wax applied thereto.

* * * * *